United States Patent [19]

Rohr et al.

[11] Patent Number: 4,967,674

[45] Date of Patent: Nov. 6, 1990

[54] SEWING MACHINE FOR SEWING ON A TAPE

[75] Inventors: Gunter Rohr, Hemmingen; Wolfgang Norz, Schwieberdingen; Horst Pordzik, Gerlingen, all of Fed. Rep. of Germany

[73] Assignee: Union Special Corporation, Chicago, Ill.

[21] Appl. No.: 268,817

[22] Filed: Nov. 8, 1988

[30] Foreign Application Priority Data

Dec. 19, 1987 [DE] Fed. Rep. of Germany ..... 3743281

[51] Int. Cl.[5] ..... D05B 35/06; D05B 35/10; D05B 23/00

[52] U.S. Cl. ..... 112/63; 112/121.26; 112/153; 112/306

[58] Field of Search ..... 112/306, 308, 121.26, 112/121.27, 121.15, 152, 153, 305, 63, 113

[56] References Cited

U.S. PATENT DOCUMENTS

| | | | |
|---|---|---|---|
| 2,539,845 | 1/1951 | Kohout | 112/152 X |
| 4,226,199 | 10/1980 | Adams | 112/308 |
| 4,467,734 | 8/1984 | Rohr | 112/153 X |
| 4,635,575 | 1/1987 | Schips | 112/305 X |
| 4,714,036 | 12/1987 | Raisin et al. | 112/121.27 X |
| 4,744,319 | 5/1988 | Rohr | 112/306 |

*Primary Examiner*—Peter Nerbun

*Attorney, Agent, or Firm*—Powell L. Sprunger

[57] ABSTRACT

A sewing machine for the controlled sewing on of a tape from a tape supply onto a tubular edge region of an elastic workpiece thus forming a band, which is provided with an additional feed dog in front of the usual feed dog in the region of the needle plate. The additional feed dog is driven by a stepping motor transversely with respect to the workpiece feed direction and is used to guide and align the workpiece. Sensors control the alignment movement of the workpiece.

9 Claims, 4 Drawing Sheets

SEWING MACHINE FOR SEWING ON A TAPE

BACKGROUND OF THE INVENTION

The present invention relates to a sewing machine for the controlled sewing of a tape onto a tubular edge region of a workpiece.

A sewing machine is known from U.S. Pat. No. 4,635,575. In this sewing machine, rubber or elastic tape is supplied and is controlled by means of a friction brake, to form an endless, elastic band, even following cutting and release from the feed device, and thus even the trailing end portion of the rubber tape can be kept under a predetermined tension up to completion of the sewing operation and can be fed to the presser foot of the sewing machine It is, however, necessary to guide and align the tubular edge region of the workpiece by hand in order to achieve precise sewing of the rubber or elastic tape onto the tubular edge region of the workpiece. This guiding and alignment operation requires a high level of concentration on the part of the sewing machine operator. When the concentration level drops, the workpiece is guided and aligned less precisely, and the result is a reduction in quality which requires the sewn-on band to be undone or leads to a reduction in the value of the workpiece.

SUMMARY OF THE INVENTION

A feature of the present invention is the provision of an improved sewing machine for sewing on a tape.

The sewing machine of the present invention provides for the controlled sewing on of a tape from a tape supply onto an edge region of a workpiece and comprises, a presser foot, a needle plate having a stitch formation point, a first feed dog for feeding the workpiece in a sewing plane in the direction of sewing, a feed device for feeding the tape to the presser foot, a second feed dog disposed in front of the first feed dog in the region of the needle plate, means for mounting the second feed dog such that it is movable in the plane of sewing transversely to the workpiece feed direction, and means operably connected to the second feed dog for imparting a movement to the workpiece which is transverse with respect to the direction of sewing.

A feature of the present invention is that the workpiece is guided and aligned independently of the operator.

Another feature of the invention is that the sewing machine insures a uniformily high level of quality of the endless band being sewn.

A further feature of the invention is that by disposing an additional feed dog in the region of the needle plate, which feed dog is controllably movable in the plane of sewing transversely with respect to the direction of workpiece feed, enables a tubular edge of the opening of a workpiece such as an elastic workpiece to be sewn to be guided and aligned precisely in a simple manner independently of the machine operator.

Yet another feature of the invention is that the additional feed dog is activated by a servometer which is operably connected to the additional feed dog.

A feature of the invention is that the guide for the additional feed dog is a rotary guide for imparting a lateral movement to the additional feed dog, which lateral movement decreases in the direction of the stitch formation point.

Another feature of the invention is that the machine produces in particular a particularly careful alignment of the workpiece to be sewn, since the workpiece can in practice no longer be moved laterally in the region of the stitch formation point.

Still another feature of the invention is that the additional feed dog is preferably controlled by at least one sensor, which monitors the edge of the opening of the workpiece.

Further features will become more fully apparent in the following description of the embodiments of this invention and from the appended claims.

DESCRIPTION OF THE PREFERRED EMBODIMENTS

Figure 1:
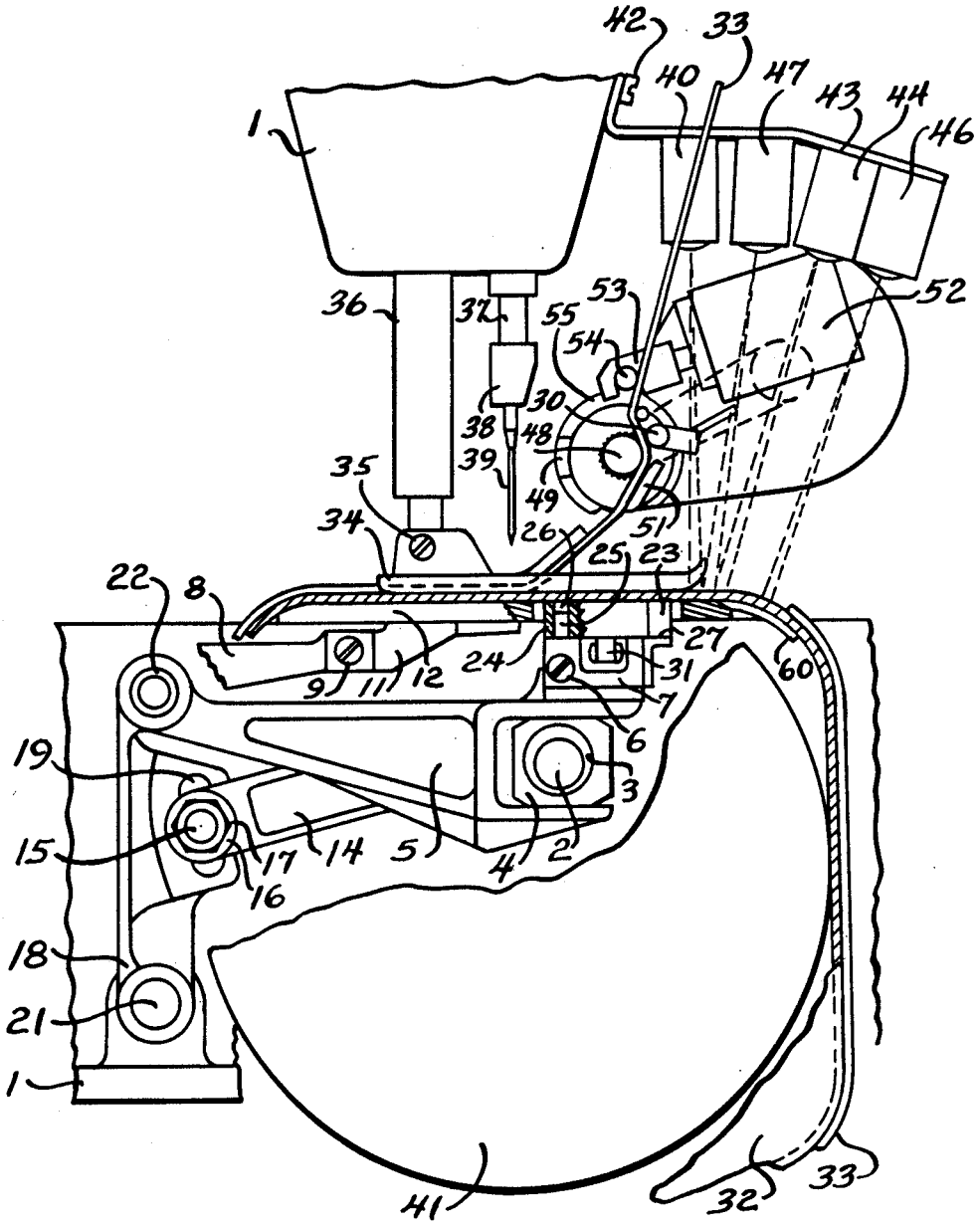
FIG. 1 is a side elevational view of a sewing machine of the present invention taken partly in section.

A sewing machine has a housing 1 in which is journalled a shaft 2, which carries a lifting eccentric 3. The lifting eccentric 3 is surrounded by a slide block 4, which is mounted in a feed dog carrier 5. An intermediate holder 7 is fastened to the feed dog carrier 5 by a screw 6 in such a way that its height is adjustable.

A feed dog 11, which is driven in a known manner and which engages through a needle plate 12, is fastened by a screw 9 to a further feed dog carrier 8.

A link 14, which is driven by way of the shaft 2 and a stroke eccentric 13 (FIG. 3), is articulated to a frame 18 by means of a stud 15, a disc 16 and a nut 17. The frame 18 contains an oblong hole 19 through which the stud 15 projects. Altering the position of the stud 15 in the oblong hole 19 alters the magnitude of feed movement of the feed dog carrier 5. A shaft 21, which is fixed to the housing, pivots the frame 18 to the housing 1. The feed dog carrier 5 is pivoted to the free end of the frame 18 by means of a hollow shaft 22.

The intermediate holder 7 carries an additional feed dog 23, which is pivotally mounted in a rotary guide 24, which is formed by a stud bolt 25 and an opening 26 in the additional feed dog 23. A support face 27 on the intermediate carrier 7 carries the additional feed dog 23, which can be moved in the plane of sewing and to which is fastened a ball stud 28, which is surrounded by a spherical shell 29 disposed on one end of a transverse guide bar 31.

The additional feed dog 23, which projects through the needle plate 12, acts on the inside of a tubular elastic workpiece 32, to which is being sewn a tape 33 from a supply to form an endless band. The tape 33 may be firm or elastic, such as, for example, a rubber tape. It may also be firm or elastic lace in the form of a tape.

A presser foot 34, which is opposite the two feed dogs 11 and 23, is fastened by a screw 35 to a presser bar 36, which is resiliently mounted in the housing 1. A needle head 38, which carries one or more needles 39, is fastened to a needle bar 37, which can move up and down. A guide member 41, at least part of which is surrounded by the workpiece 32, allows additional prior alignment of the workpiece 32.

A holder 43 is fastened to the housing 1 by a screw 42 and carries a sensor 40 for detecting the edge 45 of an opening of the workpiece 32, a sensor 44 for detecting the leading end of the seam or tape on the workpiece 32, which has already been sewn, a sensor 46 for auxiliary controlled prior alignment of the workpiece 32, and a sensor 47 for detecting the edge 50 of the opening of the tape 33.

The sensors 40, 44, 46 and 47 are in the form of light compartments, whose rays are reflected by a reflector plate 60.

The tape 33 is supplied from the supply by means of a roller 48, which is driven by a stepping motor, and a resilient counter-roller 30 of a feed device, to the presser foot 34 in such a way that the additional feed dog 23 does not act on the tape 33. A cutting device, which is driven in a controlled manner, has a movable top blade 49 and a fixed bottom blade 51 for cutting the tape 33. A top blade holder 55, which carries the top blade 49, is actuated by way of a forked head 53 and a roller 54 by means of a compressed air-operated cylinder 52.

The needle plate 12 is attached by screws 56, 57 and 58 to the housing 1 and has a stitch formation point 59 and slots 61, through which the feed dog 11 and the additional feed dog 23 engage.

Figure 2:
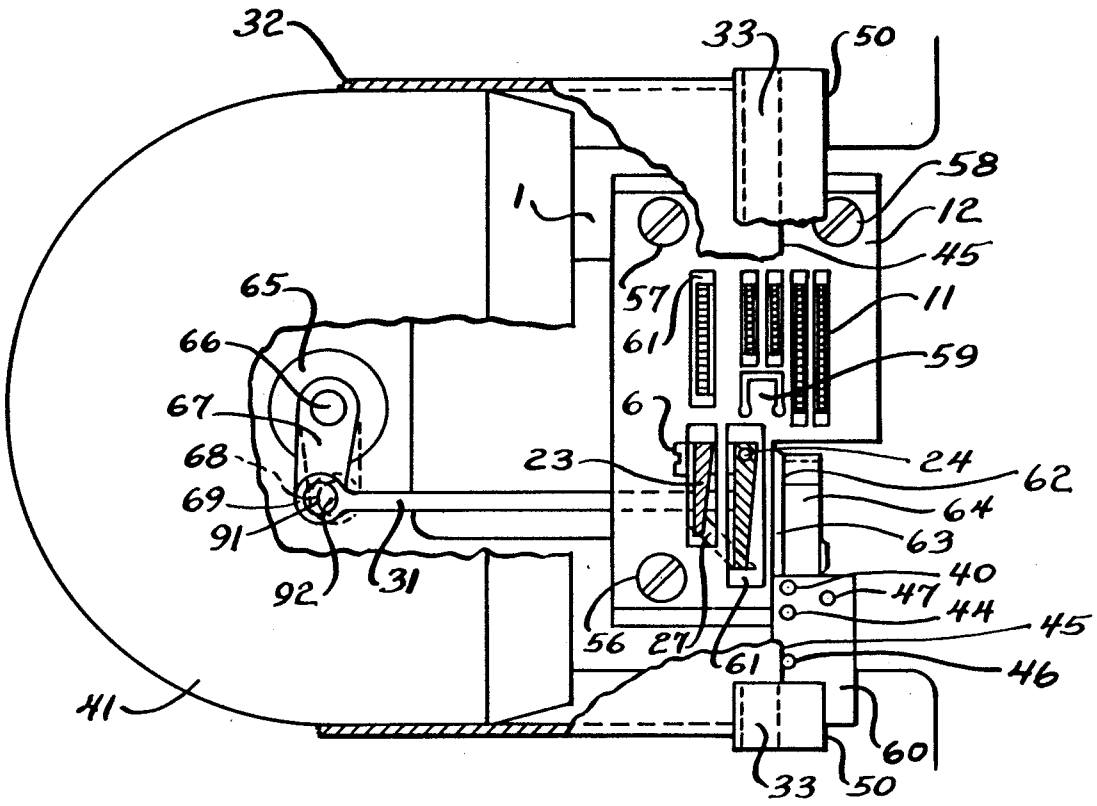
FIG. 2 is a top plan view of the sewing machine taken partly in section.

A trimming device 62 (FIG. 2), which has a fixed blade 63 and a movable, lowerable hook-shaped blade 64, is provided for levelling the opening edge 45 of the workpiece 32 and for trimming off narrow strips of workpiece projecting laterally beyond the opening edge 45, which strips are removed from the trimming zone by a suction device.

Figure 5:
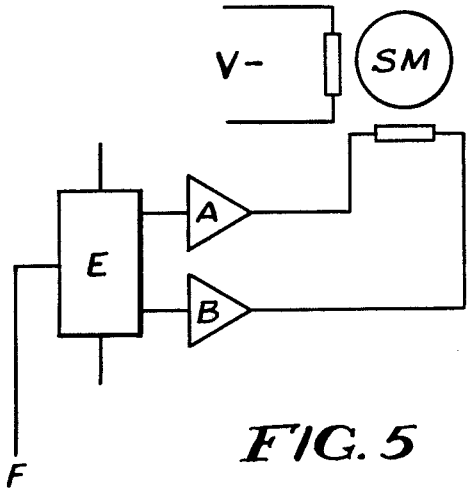
FIG. 5 is a block diagram of a stepping motor control for the sewing machine.

An electrically driven stepping motor (SM) 65, which is controlled by the sensor 40 and a circuit shown schematically in FIG. 5, has a shaft 66 to which is connected a crank arm 67 so as to be non-rotatable. A ball stud 68 on the crank arm 67 is surrounded by a spherical shell 69, which is disposed on the other end of the transverse guide bar 31.

Figure 3:
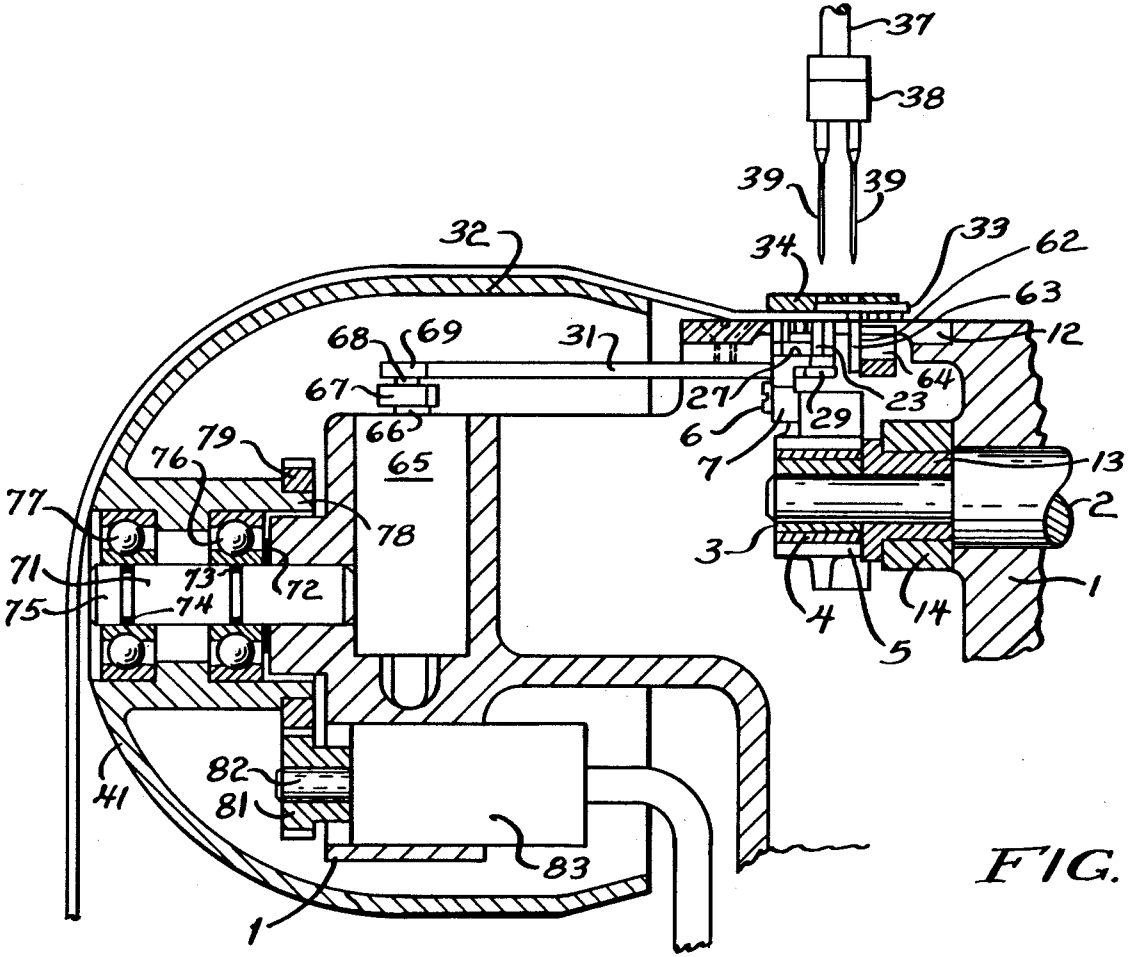
FIG. 3 is a front sectional view of the sewing machine.
Figure 4:
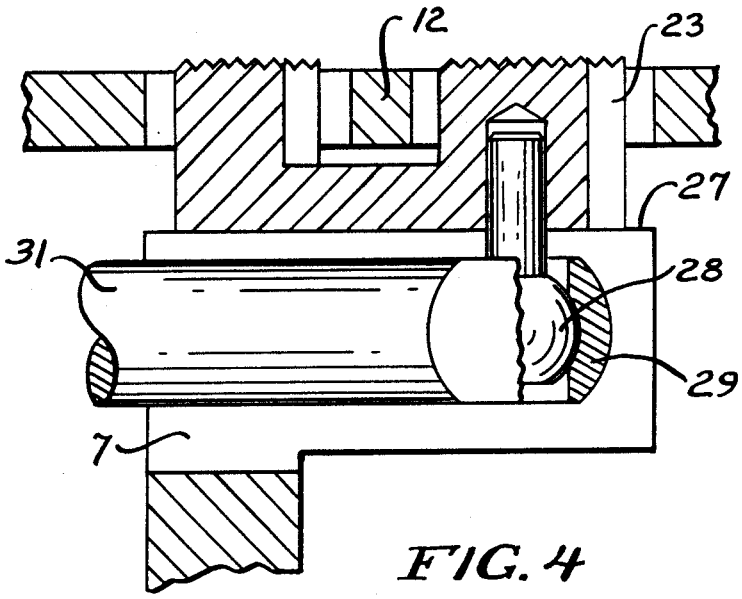
FIG. 4 is a fragmentary sectional view on an enlarged scale showing a pivot drive of an additional feed dog of FIG. 3.

As shown in FIG. 3, a shaft 71, which is fixed to the housing, carries a spacer ring 72 and resilient rings 73 and 74. The center of the shaft 71 forms the center 75 of rotation of the guide member 41. An inner boss 79 of the latter contains ball bearings 76 and 77, which are in clamping contact with the resilient rings 73 and 74 respectively. As a result, the guide member 41 can be simply pulled off the shaft 71 during maintenance work or can be replaced by another guide member when changing over sewing production. A gear rim 79 is pressed onto the inner boss 79 of the guide member 41 and meshes with a pinion 81, which is secured on a shaft 82 of a stepping motor 83, which in turn is mounted in the housing 1.

As shown in FIG. 5, a direct voltage V- is applied to one phase of the two-phase stepping motor SM (stepping motor 65) of the sewing machine. Current is fed to the second phase through two driver stages A and B which are in turn controlled by a bistable element E. The bistable element E is in turn synchronously controlled and has a logic signal input F. This control of the stepping motor 65 ensures that the mechanical movement of the additional feed dog 23 is in synchronism with the electronic control of the stepping motor 65, whereby it is also ensured that the stepping motor 65 can be repeatably moved between only two step positions 91 and 92. Known controls for two-phase stepping motors usually have four driver stages for supplying current to the two phases of the stepping motor 65. The series-connected electronic control which is required for this does not guarantee that the stepping motor 65 only takes up the two necessary step positions 91 and 92, since, depending on the input of the logic signals, these controls also allow the stepping motor to be further switched electrically into an unwanted step position.

The illustrated embodiment of the sewing machine operates as follows:

A known position motor drives the sewing machine in an operating cycle, which sewing machine has known devices for raising the presser foot 34, severing the sewing threads and positioning the needle 19. The tubular workpiece 32 to be sewn is inserted under the presser foot 34 and the leading end of the tape 33 and is placed laterally against the movable hook-like blade 64. Then the operating cycle is started, that is, the presser foot 34 is lowered and the feed dogs 11 and 23 feed the workpiece 32 in the workpiece feed direction (direction of sewing). At the same time, the controllably driven roller 48 feeds tape 33 from the supply to the presser foot 34. The sensor 40 scans the edge 45 of the opening of the workpiece 32. If the sensor 40 detects the workpiece 32, the stepping motor 65 is given the command to pull the additional feed dog 23 towards the guide member 41 by means of the transverse guide bar 31 after it has emerged at the top from the slots 61 in the needle plate 12. If it does not detect the workpiece 32, the stepping motor 65 is given the command to push the additional feed dog 23 away from the guide member 41 by means of the transverse guide bar 31.

During or following dipping of the additional feed dog 23 below the surface of the needle plate 12, the light sensor 40 gives the stepping motor 65 the control command "step position 91" or "step position 92". If it is already in the appropriate step position, it does not move while the additional feed dog 23 is below the surface of the needle plate 12. If it is not yet in the appropriate step position, it moves into it. When the shaft 2 has completed predetermined, adjustable angle of rotation, for example 170°, the stepping motor 65 initiates a pivoting movement into the other step position, that is, when the additional feed dog 23 has been applied to the workpiece 32 after it has emerged at the top through the slots 61 in the needle plate 12. This causes a lateral alignment movement of the workpiece 32.

Only one sensor 40 is required for this type of control using two step positions 91 and 92 of the stepping motor 65, and this provides for a simple solution, since there is no alignment movement of the additional feed dog 23 in either step position 91 or step position 92 when the control command is suppressed.

It is also possible to scan the edge 45 of the opening of the workpiece 32 between two adjacently disposed sensors. In doing so, the control command to move the additional feed dog 23 laterally may be suppressed as long as the opening edge 45 of the workpiece 32 moves laterally only between the two sensors.

When controlling the additional feed dog 23, it is thus important that the stepping motor 65 is moved backwards and forwards within a single step length. It has been found that this single length is sufficient for functional control of the additional feed dog 23. This drive and this control of the additional feed dog 23, which causes transverse feed of the workpiece 32, with the aid of the multiple-phase stepping motor 65, which is driven backwards and forwards within a single step by only two driver stages A, B, are suitable not only for the above-described sewing machine for sewing on a tape, but also generally for reciprocatingly driven devices of any type. In general, this provides the advantage that a stepping motor which reacts rapidly to control commands can be used to move parts of the device backwards and forwards within, for example, 1 to 3 milliseconds over a path of, for example, 0.5 to 2 mm given a lever arm of, for example, 15 mm.

The pushing or pulling movement of the additional feed dog 23 above the surface of the needle plate takes place against the pressure of the presser foot 34. When the control command is suppressed, the additional feed dog 23, together with the feed dog 11, pushes the workpiece 32 in the workpiece feed direction only.

In the embodiment shown in the drawing, the stepping motor 65, whose control is timed or synchronized by way of a position sensor, may impart a lateral pulling and pushing motion to the additional feed dog 23 by means of the transverse guide bar 31 during each individual revolution of the shaft 2, which movement is superimposed on the feed movement of the additional feed dog 23. As a result, the workpiece 32 can be actively laterally guided and aligned during each revolution of the shaft 2.

An additional prealignment movement can be imparted to the workpiece 32 by the guide member 41. The sensor 46 controls the stepping motor 83, which drives the guide member 41 and whose basic step frequency is synchronously controlled by way of the position sensor, that is, its basic circumferential speed is synchronized with the sewing speed. The alignment movement of the workpiece 32 is caused by a higher or lower circumferential speed of the guide member 41 relative to the sewing speed. Because of the lateral spacing of the guide member 41 with respect to the stitch formation point 59, a clockwise or anticlockwise torque is imparted to the workpiece 32 in advance of the stitch formation point 59.

The workpiece edge 45 continues to be aligned by the additional feed dog 23 and the guide member 41 until the leading end of the seam or the tape 33 again approaches the needle plate 12.

The sensor 44 controls the severing of the tape 33, the stopping of the roller 48 and the lowering of the hook-shaped blade 64. If the sensor 40 is then covered by the leading end of the tape 33, the sensor 47 takes over alignment control of the workpiece 32. It monitors the edge 50 of the opening formed by the tape 33. Since the additional feed dog 23 is only in contact with the workpiece 32 and not the tape 33, the guide member 41 undertakes the lateral alignment movement of the workpiece 32 with the tape 33, which has already been sewn on, until the trailing end of the tape has also been sewn on. Then the known thread cutting device severs the sewing threads, the presser foot 34 and the hook-shaped blade 64 are raised again and a predetermined quantity of tape 33 is pushed under the presser foot 34 by means of the roller 48.

The foregoing detailed description is given for clearness of understanding only, and no unnecessary limitations should be understood therefrom, as modifications will be obvious to those skilled in the art.

What is claimed is:

1. A sewing machine for the controlled sewing on of a tape from a tape supply onto a tubular edge region of an elastic workpiece, thus forming a band, comprising a presser foot, a needle plate having a stitch formation point, a first feed dog for feeding the workpiece in a sewing plane in the direction of sewing, a feed device for feeding the tape to the presser foot, a severing device for severing the tape, a second feed dog disposed in front of the first feed dog in the region of the needle plate, which is mounted on a carrier in a guide and is controllably movable in the plane of sewing transversely to the workpiece feed direction, a servomotor operably connected to the second feed dog for imparting a movement to the workpiece which is transverse with respect to the direction of sewing, in which the guide for the additional feed dog is a rotary guide imparting a lateral movement to the additional feed dog, which lateral movement decreases in the direction of the stitch formation point.

2. A sewing machine as claimed in claim 1, in which a guide bar operably connects the servomotor, which is a stepping motor, to the second feed dog.

3. A sewing machine as claimed in claim 1, in which at least one sensor is disposed in advance of the stitch formation point in the direction of sewing and is laterally spaced therefrom by a distance corresponding to the desired position of the edge of the opening of the workpiece and the alignment movement of the workpiece is controllable.

4. A sewing machine as claimed in claim 1, in which a sensor is disposed in advance of the stitch formation point in the direction of sewing, and is laterally spaced therefrom by a distance which corresponds to the desired position of the edge of the opening formed by the tape.

5. A sewing machine as claimed in claim 1, in which a guide member is provided and is adapted to be driven in a sensor-controlled manner, associated with the sewing machine, so as to act on the workpiece which at least partly surrounds the guide member.

6. A sewing machine as claimed in claim 5, in which the guide member is driven by means of a stepping motor.

7. A sewing machine for the controlled sewing on of a tape from a tape supply onto a tubular edge region of an elastic workpiece, thus forming a band, comprising a presser foot, a needle plate having a stitch formation point, a first feed dog for feeding the workpiece in a sewing plane in the direction of sewing, a feed device for feeding the tape to the presser foot, a severing device for severing the tape, a second feed dog disposed in front of the first feed dog in the region of the needle plate, which is mounted on a carrier in a guide and is controllably movable in the plane of sewing transversely to the workpiece feed direction, a servomotor operably connected to the second feed dog for imparting a movement to the workpiece which is transverse with respect to the direction of sewing, in which a stepping motor is electrically repeatably movable to no more than two step positions.

8. A sewing machine as claimed in claim 7, in which the stepping motor is a two-phase motor and a direct voltage is applied to a first phase of the two-phase stepping motor and current is supplied to a second phase of the stepping motor through two driver stages, and these driver stages are in turn controlled by a bistable element.

9. A sewing machine for the controlled sewing on of a tape from a tape supply onto a tubular edge region of an elastic workpiece, thus forming a band, comprising a presser foot, a needle plate having a stitch formation point, a first feed dog for feeding the workpiece in a sewing plane in the direction of sewing, a feed device for feeding the tape to the presser foot, a severing device for severing the tape, a second feed dog disposed in front of the first feed dog in the region of the needle plate, which is mounted on a carrier in a guide and is controllably movable in the plane of sewing transversely to the workpiece feed direction, a servomotor operably connected to the second feed dog for imparting a movement to the workpiece which is transverse with respect to the direction of sewing, in which a trimming device is provided for trimming the edge of the opening of the tubular workpiece and is disposed in front of the stitch formation point in the direction of sewing, and is laterally spaced therefrom by an amount which corresponds substantially to the desired position of the edge of the opening of the workpiece.

* * * * *

UNITED STATES PATENT AND TRADEMARK OFFICE

CERTIFICATE OF CORRECTION

PATENT NO. : 4,967,674

DATED : November 6, 1990

INVENTOR(S) : Rohr et al.

It is certified that error appears in the above-identified patent and that said Letters Patent is hereby corrected as shown below:

On the title page, in item [73], please change the Assignee from "Union Special Corporation, Chicago, Ill." to --Union Special G.m.b.H., Stuttgart, Germany--

Signed and Sealed this

Twenty-fifth Day of August, 1992

*Attest:*

DOUGLAS B. COMER

*Attesting Officer*

*Acting Commissioner of Patents and Trademarks*